US005790978A

United States Patent [19]

Olive et al.

[11] Patent Number: 5,790,978

[45] Date of Patent: Aug. 4, 1998

[54] SYSTEM AND METHOD FOR DETERMINING PITCH CONTOURS

[75] Inventors: Joseph Philip Olive, Watchung, N.J.; Jan Pieter VanSanten, Brooklyn, N.Y.

[73] Assignee: Lucent Technologies, Inc., Murray Hill, N.J.

[21] Appl. No.: 528,576

[22] Filed: Sep. 15, 1995

[51] Int. Cl.[6] ..... G10L 5/04

[52] U.S. Cl. ..... 704/207; 704/205; 704/231; 704/234; 704/236

[58] Field of Search ..... 395/2.09, 2.14, 395/2.15, 2.16, 2.18, 2.4, 2.43, 2.45, 2.44, 2.69

[56] References Cited

U.S. PATENT DOCUMENTS 4,695,962 9/1987 Goudie ..... 395/2.76
4,797,930 1/1989 Goudie ..... 395/2.77
4,908,867 3/1990 Silverman ..... 395/2.69
5,212,731 5/1993 Zimmermann ..... 395/2.69
5,475,796 12/1995 Iwata ..... 395/2.69

*Primary Examiner*—Allen R. MacDonald
*Assistant Examiner*—Alphonso A. Collins

[57] ABSTRACT

A system and method are provided for automatically computing local pitch contours from textual input to produce pitch contours that closely mimic those found in natural speech. The methodology of the invention incorporates parameterized equations whose parameters can be estimated directly from natural speech recordings. That methodology incorporates a model based on the premise that pitch contours instantiating a particular pitch contour class can be described as distortions in the temporal and frequency domains of a single, underlying contour. After the nature of the pitch contour for different pitch contour classes has been established, a pitch contour can be predicted that closely models a natural speech contour for a synthetic speech utterance by adding the individual contours of the different intonational classes and adjusting the boundaries of these to match the boundaries of the adjacent intonation curves.

25 Claims, 4 Drawing Sheets

SYSTEM AND METHOD FOR DETERMINING PITCH CONTOURS

FIELD OF THE INVENTION

This invention relates to the art of speech synthesis and more particularly to the determination of pitch contours for text to be synthesized into speech.

BACKGROUND OF THE INVENTION

In the art of speech synthesis, a fundamental goal is that the synthesized speech be as human-like as possible. Thus, the synthesized speech must include appropriate pauses, inflections, accentuation and syllabic stress. In other words, speech synthesis systems which can provide a human-like delivery quality for non-trivial input textual speech must be able to correctly pronounce the "words" read, to appropriately emphasize some words and de-emphasize others, to "chunk" a sentence into meaningful phrases, to pick an appropriate pitch contour and to establish the duration of each phonetic segment, or phoneme. Broadly speaking, such a system will operate to convert input text into some form of linguistic representation that includes information on the phonemes to be produced, their duration, the location of any phrase boundaries and the pitch contour to be used. This linguistic representation of the underlying text can then be converted into a speech waveform.

With particular respect to the pitch contour parameter, it is well known that good intonation, or pitch, is essential for speech synthesis to sound natural. Prior art speech synthesis systems have been able to approximate the pitch contour, but have not in general been able to achieve the natural sounding quality of the speech style sought to be emulated.

It is well known that the computation of natural intonation (pitch) contours from text—for use by a speech synthesizer—is a highly complex undertaking. An important reason for that complexity is that it is not sufficient to specify only that the contour must reach some high value as to a to-be-emphasized syllable. Instead, the synthesizer process must recognize and deal with the fact that the exact height and temporal structure of a contour depend on the number of syllables in a speech interval, the location of the stressed syllable and the number of phonemes in the syllable and in particular on their durations and voicing characteristics. Failure to appropriately deal with these pitch factors will result in synthesized speech which does not adequately approach the human-like quality desired for such speech.

SUMMARY OF THE INVENTION

A system and method are provided for automatically computing pitch contours from textual input to produce pitch contours that closely mimic those found in natural speech. The methodology of the invention incorporates parameterized equations whose parameters can be estimated directly from natural speech recordings. That methodology incorporates a model based on the premise that pitch contours instantiating a particular pitch contour class (e.g., final rise in a yes/no question) can be described as distortions in the temporal and frequency domains of a single, underlying contour.

After the nature of the pitch contour for different pitch contour classes has been established, a pitch contour can be predicted that closely models a natural speech contour for a synthetic speech utterance by adding the individual contours of the different intonational classes.

DETAILED DESCRIPTION OF THE INVENTION

Figure 1:
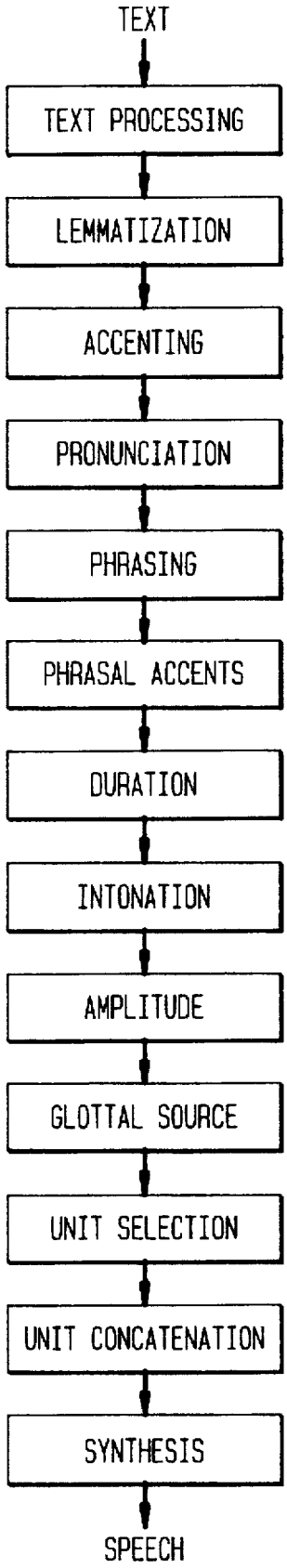
FIG. 1 depicts in functional form the elements of a text-to-speech synthesis system.

The discussion following will be presented partly in terms of algorithms and symbolic representations of operations on data bits within a computer system. As will be understood, these algorithmic descriptions and representations are a means ordinarily used by those skilled in the computer processing arts to convey the substance of their work to others skilled in the art.

As used herein (and generally) an algorithm may be seen as a self-contained sequence of steps leading to a desired result. These steps generally involve manipulations of physical quantities. Usually, though not necessarily, these quantities take the form of electrical or magnetic signals capable of being stored, transferred, combined, compared and otherwise manipulated. For convenience of reference, as well as to comport with common usage, these signals will be described from time to time in terms of bits, values, elements, symbols, characters, terms, numbers, or the like. However, it should be emphasized that these and similar terms are to be associated with the appropriate physical quantities—such terms being merely convenient labels applied to those quantities.

It is important as well that the distinction between the method of operations and operating a computer, and the method of computation itself should be kept in mind. The present invention relates to methods for operating a computer in processing electrical or other (e.g., mechanical, chemical) physical signals to generate other desired physical signals.

For clarity of explanation, the illustrative embodiment of the present invention is presented as comprising individual functional blocks (including functional blocks labeled as "processors"). The functions these blocks represent may be provided through the use of either shared or dedicated hardware, including, but not limited to, hardware capable of executing software. For example the functions of processors presented in FIG. 5 may be provided by a single shared processor. (Use of the term "processor" should not be construed to refer exclusively to hardware capable of executing software.)

Illustrative embodiments may comprise microprocessor and/or digital signal processor (DSP) hardware, such as the AT&T DSP16 or DSP32C, read-only memory (ROM) for storing software performing the operations discussed below, and random access memory (RAM) for storing results. Very large scale integration (VLSI) hardware embodiments, as well as custom VLSI circuity in combination with a general purpose DSP circuit, may also be provided.

In a text-to-speech (TTS) synthesis system, a primary objective is the conversion of text into a form of linguistic representation, where that linguistic representation usually includes information on the phonetic segments (or phonemes) to be produced, the durations of such segments, the locations of any phrase boundaries, and the pitch contour to be used. Once that linguistic representation has been determined, the synthesizer operates to convert that information to a speech waveform. The invention is focused on the pitch contour portion of the linguistic representation of converted text, and particularly a novel approach to a determination of that pitch contour. Prior to describing this methodology, however, it is believed that a brief discussion of the operation of a TTS synthesis system will assist a more complete understanding of the invention.

As an illustrative embodiment of a TTS system, reference is made herein to the TTS system developed by AT&T Bell Laboratories and described in Sproat, Richard W. and Olive, Joseph P. 1995. "Text-to-Speech Synthesis", *AT&T Technical Journal*, 74(2), 35–44. That AT&T TTS system, which is believed to represent the state of the art in speech synthesis systems, is a modular system. The modular architecture of the AT&T TTS system is illustrated in FIG. 1. Each of the modules is responsible for one piece of the problem of converting text into speech. In operation, each module reads in the structures one textual increment at a time, performs some processing on the input and then writes out the structure for the next module.

Figure 2:
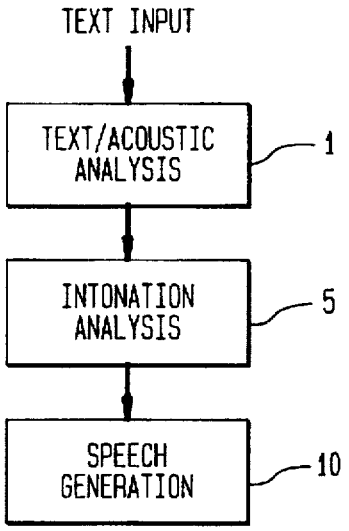
FIG. 2 shows in block diagram form a generalized TTS system structured to emphasize contribution of invention.

A detailed description of the function performed by each of the modules in this illustrative TTS system is not needed here, but a general functional description of the TTS operation will be useful. To that end, reference is made to FIG. 2 which provides a somewhat more generalized depiction of a TTS system, such as the system of FIG. 1. As shown in FIG. 2, input text is first operated on by a Text/Acoustic Analysis function, 1. That function essentially comprises the conversion of the input text into a linguistic representation of that text. An initial step in such text analysis will be the division of the input text into reasonable chunks for further processing, such chunks usually corresponding to sentences. Then these chunks will be further broken down into tokens, which normally correspond to words in a sentence constituting a particular chunk. Further text processing includes the identification of phonemes for the tokens being synthesized, determination of the stress to be placed on various syllables and words comprising the text, and determining the location of phrase boundaries for the text and the duration of each phoneme in the synthesized speech. Other, generally less important functions may also be included in this text/acoustic analysis function, but they need not be further discussed herein.

Following application of the text/acoustic analysis function, the system of FIG. 2 performs the function depicted as Intonation Analysis 5. This function, which is performed by the methodology of the invention determines the pitch to be associated with the synthesized speech. The end product of this function, a pitch contour—also denoted an $F_0$ contour—is produced for association with other speech parameters previously computed for the speech segment under consideration.

The final functional element in FIG. 2, Speech Generation, 10, operates on data and/or parameters developed by preceding functions—particularly the phonemes and their associated durations and the fundamental frequency contour $F_0$ —in order to construct a speech waveform corresponding to the text being synthesized into speech.

As is well known, proper application of intonation is very important in speech synthesis to achieve a human-like speech waveform. Intonation serves to emphasize certain words and to de-emphasize others. It is reflected in the $F_0$ curve for a particular word or phrase being spoken, which curve will typically have a relative high point for an emphasized word or portion thereof, as well as a relative low point for de-emphasized portions. While the proper intonation will be applied almost "naturally" to a human speaker (being of course in actual fact a resultant of processing by that speaker of a vast amount of a priori knowledge related to speech forms and grammatical rules), the challenge for a speech synthesizer is to compute that $F_0$ curve based only on input of the text of the word or phrase to be synthesized into speech.

I. Description of the Preferred Embodiment

A. Methodology of the Invention

The general framework for the methodology of the invention begins with a principle previously established by Fujisaki [Fujisaki, H., "A note on the physiological and physical basis for the phrase and accent components in the voice fundamental frequency contour", In: *Vocal physiology: voice production, mechanisms and functions*, Fujimura (Ed.), New York, Raven, 1988] that a complicated pitch contour can be described as a sum of two types of component curves—(1) a phrase curve and (2) one or more accent curves (where the term "sum" is to be understood as generalized addition (Krantz et al, *Foundations of Measurement*, Academic Press, 1971), and includes many mathematical operations other than standard addition). However, in Fujisaki's model, the phrase curve and the accent curves are given by very restrictive equations. Additionally, Fujisaki's accent curves are not tied to syllables, stress groups, etc., so that computation from linguistic representations is difficult to specify. To some extent, these limitations are addressed by the work of Mobius [Mobius, B., Patzold, M. and Hess, W., "Analysis and synthesis of German F0 contours by means of Fujisaki's model", *Speech Communication*, 13, 1993] who showed that accent curves could be tied to accent groups—where an accent group begins with a syllable which is both lexically stressed and is part of a word which is itself accented (i.e., emphasized) and continues to the next syllable which satisfies both of those conditions. Under that model, each accent curve will be temporally aligned, in some sense, with the accent group. However, the accent curves of Mobius are not aligned in any principled manner with the internal temporal structure of the accent group. Additionally, the Mobius model continues the Fujisaki limitation that the equations for the phrase and accent curves are very restrictive.

Using these background principles as a starting point, the methodology of the invention overcomes the limitations of these prior art models and enables the computation of a pitch contour which closely models a natural speech contour for a synthetic speech utterance.

With the methodology of the invention, an essential goal is the generation of the appropriate accent curve. The primary input to this process will be the phonemes within the accent group under consideration (the text comprising each such accent group being determined in accordance with the rule of Mobius defined above, or variants of such a rule), and the duration of each of those phonemes, each of which parameters having been generated by known methods in preceding modules of the TTS.

As discussed more particularly below, the accent curve computed by the method of the invention may be added to the phrase curve for that interval to produce an $F_0$ curve. Accordingly, a preliminary step would involve the generation of that phrase curve. The phrase curve is typically computed by interpolation between a very small number of points—for example, the three points corresponding to the start of the phrase, the start of the last accent group, and the end of the last accent group. The $F_o$ values of these points may vary for different phrase types (e.g., yes-no vs. declarative phrase).

As a first step in the process of generating the accent curve for a particular accent group, certain critical interval durations are computed, based on the phoneme durations within each such interval. In a preferred embodiment, three critical intervals are computed, although it will be apparent to those skilled in the art that more, less or entirely different intervals could be used. The critical intervals for the preferred embodiment are defined as:

$D_1$—total duration for initial consonants in first syllable of accent group $D_2$—duration of phonemes in remainder of first syllable $D_3$—duration of phonemes in remainder of accent group after first syllable Although the sum of $D_1$, $D_2$ & $D_3$ will generally be equal to the sum of the durations of the phonemes in the accent group, such is not necessarily the case. For example, interval $D_3$ could be transformed to a new $D_3'$ where the interval would never exceed a predetermined value. In that circumstance, if the sum of the phoneme durations in interval $D_3$ exceeded the that arbitrary value, $D_3'$ would be truncated to that arbitrary value.

The next step in the process of the invention for generating the accent curve is in the computation of a series of values designated as anchor times. The ith anchor time is determined according to the following equation:

$$T_i=\alpha_{ic}D_1+\beta_{ic}D_2+\gamma_{ic}D_3 \quad (1)$$

where $D_1$, $D_2$ & $D_3$ are the critical intervals defined above, $\alpha$,$\beta$ & $\gamma$ are alignment parameters (discussed below), i is an index for the anchor time under consideration and c refers to the phonetic class of the accent group—e.g., accent groups which begin with a voiceless stop. More particularly, the phonetic class of an accent group, c, is defined in terms of the phonetic classification of certain phonemes within the accent group—specifically, the phonemes at the beginning and at the end of the accent group. Stated somewhat differently, the phonetic class c represents a dependency relationship between the alignment parameters, $\alpha$, $\beta$ & $\gamma$, and the phonemes in the accent group.

The alignment parameters $\alpha$, $\beta$ & $\gamma$ will have been determined (from actual speech data) for a multiplicity of phonetic classes, and within each such class, for each anchor time interval that characterizes the current model—e.g., at 5, 20, 50, 80 and 90 percent of the peak height of the $F_0$ curve (after subtracting the phrase curve) on both sides of the peak. To illustrate the procedure by which such parameters are determined, the application of that procedure for accent groups of the rise-fall-rise type is herein described. For appropriate recorded speech, $F_0$ is computed and critical time intervals are indicated. In speech appropriate for this accent type, the targeted accent group roughly coincides with a single-peaked local curve. Subsequently, for the time interval $[t_0,t_1]$ comprising the targeted accent group, a curve (the Locally Estimated Phrase Curve) is drawn between the points $[t_0,F_0(t_0)]$ and $[t_1, F_0(t_1)]$; typically, this curve is a straight line, either in the linear or the logarithmic frequency domain. The Locally Estimated Phrase Curve is then subtracted from the $F_0$ curve to generate a residual curve (the Estimated Accent Curve) which for this particular accent type starts at a value of 0 at time=$t_0$ and ends on a value of 0 at $t_1$. Anchor times correspond to time points where the Estimated Accent Curve is a given percentage of the peak height.

For other accent types (e.g., the sharp rise at the end of yes-no questions) essentially the same procedure can be followed, with minor changes in the computation of the Locally Estimated Phrase Curve and the Estimated Accent Curve. A simple linear regression is performed to predict anchor times from these durations. The regression coefficients correspond to the alignment parameters. Such alignment parameter values would then be stored in a look-up table, from which specific values of aic, $\alpha_{ic}$, $\beta_{ic}$ & $\gamma_{ic}$ would be determined for use in Equation (1) to compute each of the anchor times $T_i$.

It is to be noted that the number, N, of time intervals i defining the number of anchor times across an accent group is somewhat arbitrary. The inventors have empirically implemented the method of the invention using in one case N=9 anchor points per accent group and in another case, N=14 anchor points, both to good effect.

Figure 3:
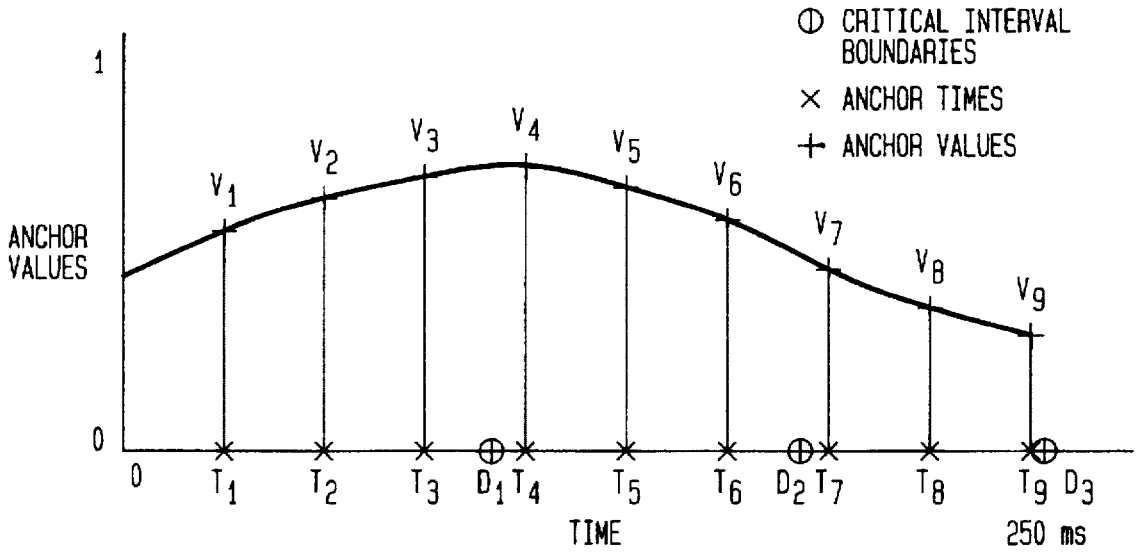
FIG. 3 provides a graphical illustration of the contour generation process of the invention.

The third step in the method of the invention is best explained by reference to FIG. 3 which represents an x-y axis upon which a curve is constructed in accordance with the discussion following. The x axis represents time and the durations of all of the phonemes in the accent group are plotted along this time scale, where the y intercept is 0 time and corresponds to the beginning of the accent group; the last point plotted, illustratively shown here as 250 ms, represents the end point of the accent group, i.e., the end of the last phoneme in the accent group. Also plotted on this time axis are the anchor times computed in the prior step. For this illustrative embodiment, the number of anchor times computed is assumed to be 9, so that those anchor times indicated in FIG. 3 are designated $T_1$, $T_2$, . . . $T_9$. For each of the computed anchor points, an anchor value, $V_i$ corresponding to such anchor point will be obtained from a look-up table and plotted on the graph of FIG. 3 at the x coordinate corresponding to the associated anchor time and at the y coordinate corresponding to that anchor value—such anchor values, for the purposes of illustration, having a range of 0 to 1 units on the y axis. A curve is then fitted to, or drawn through the plotted $V_i$; points in FIG. 3 using a known interpolation methodology.

The anchor values in that look-up table are computed from natural speech in the following manner. A large number of accent curves from the natural speech—which are obtained by subtracting the Locally Estimated Phrase Curves from the $F_0$ curves—are averaged and the averaged accent curve is then normalized so that the y-axis values are between 0 and 1. Then for a number of points spaced along the x-axis (preferably equally spaced) of that normalized accent curve (that number corresponding to the number of anchor points in the chosen model) the anchor values are read from the normalized accent curve and placed in the look-up table.

In the fourth step of the process of the invention, the interpolated and smoothed anchor value ($V_i$) curve determined in the previous step is multiplied (where multiplication is to be understood as generalized multiplication (Krantz et al.), and includes many mathematical operations other than standard multiplication) by numerical constants whose values reflect linguistic factors such as degree of prominence of an accent group, or location of the accent group in the sentence. As will be apparent to those skilled in the art, this product curve will have the same general shape as that of the $V_i$ curve, but all of the y values will be scaled up by the multiplication constant(s). The product curve so obtained, when added back to the phrase curve, may be used as the $F_0$ curve for the accent group under consideration, and (once all other product curves have been added similarly)

will provide a much closer match to natural speech than prior art methods for computing the $F_0$ contour. However, a still further improvement in the achieved $F_0$ contour will be described hereafter.

Figure 4:
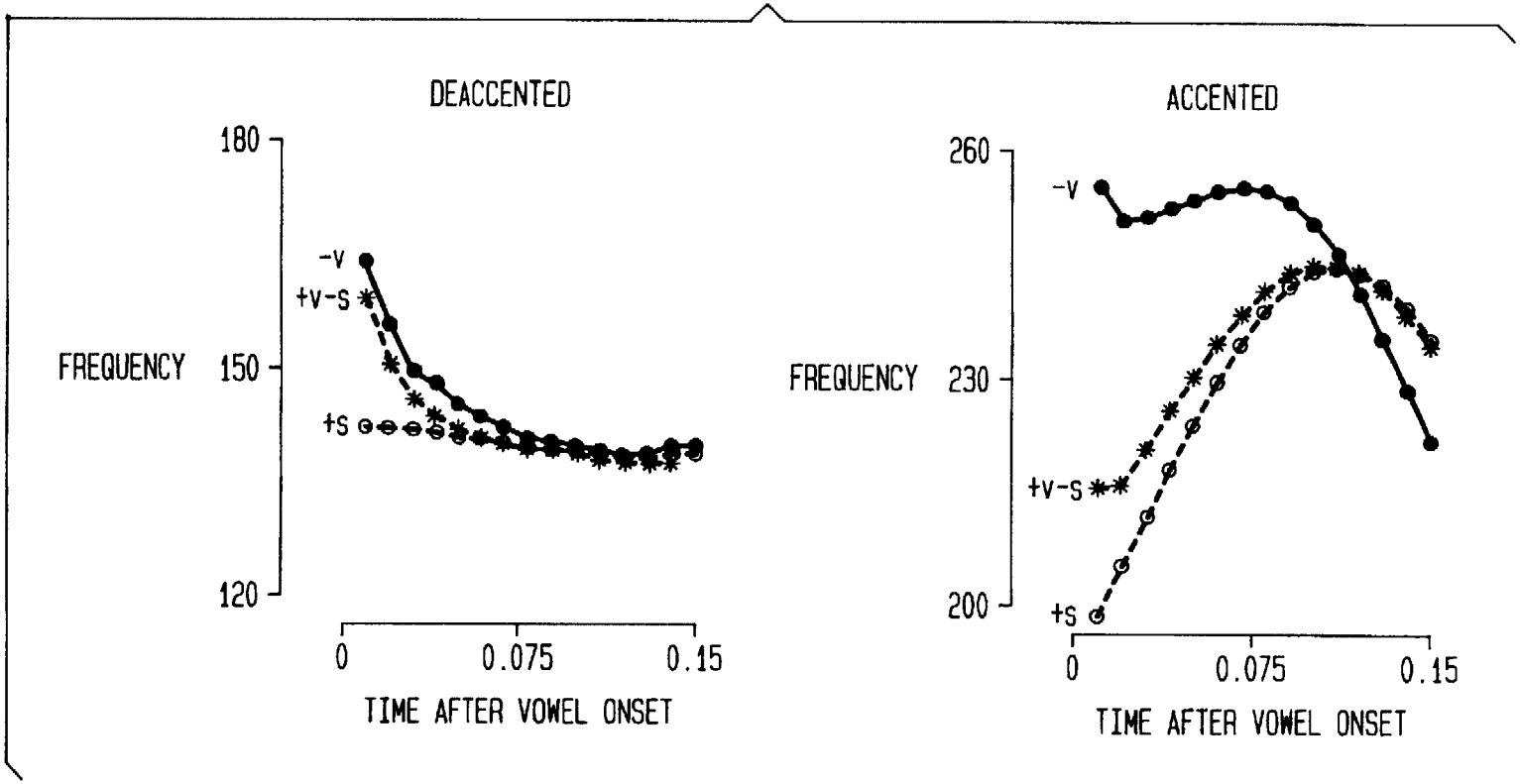
FIG. 4 shows illustrative deaccented and accented perturbation curves.

The $F_0$ contour computed in the prior step can, however, be still further improved by the addition of the appropriate obstruent perturbation curve(s) to the product curve computed in that prior step. It is known that a perturbation to the natural pitch curve where a consonant precedes a vowel is an obstruent. In the method of the invention, the perturbation parameter for each obstruent consonant is determined from natural speech data and that set of parameters stored in a look-up table. Then when an obstruent is encountered in an accent group, the perturbation parameter for that obstruent is obtained from the table, multiplied with a stored prototypical purturbation curve and added to the curve computed in the prior step. The prototypical purturbation curves can be obtained by comparison of $F_0$ curves for various types of consonants preceding a vowel in deaccented sylables, as shown in the left panel of FIG. 4.

In the further operation of the TTS system, the $F_0$ curve computed in accordance with the foregoing methodology is incorporated with previously computed duration and other factors, with the TTS going on to ultimately convert all of this collected linguistic information into a speech waveform.

B. TTS Implementation of Invention

Figure 5:
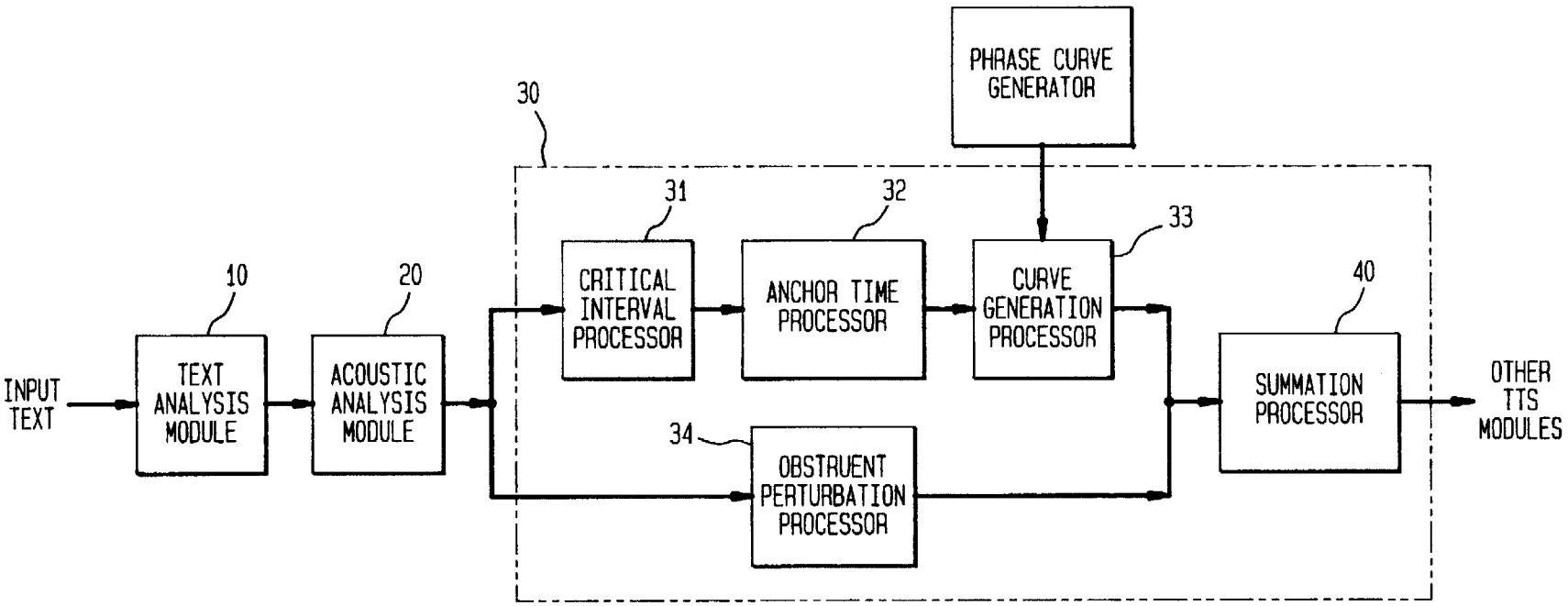
FIG. 5 depicts in block diagram form and implementation of the invention in the context of a TTS system.

FIG. 5 provides an illustrative application of the invention in the context of a TTS system. As will be seen from that figure, input text is initially operated on by Text Analysis Module 10 and thence by Acoustic Analysis Module 20. These two modules, which may be of any known implementation, generally operate to convert the input text into a linguistic representation of that text, corresponding to the Text/Acoustic Analysis function previously described in connection with FIG. 2. The output of Acoustic Analysis Module 20 is then provided to Intonation Module 30 which operates according to the invention. Specifically, Critical Interval Processor 31 operates to establish accent groups for preprocessed text received from a prior module and divide each accent group into a number of critical intervals. Using these critical intervals, and the durations thereof, Anchor Time Processor 32 then determines a set of alignment parameters and computes a series of anchor times using a relationship between the critical interval durations and those alignment parameters. Curve Generation Processor 33 takes the anchor times so computed and makes a determination of a corresponding set of anchor values from a previously generated look-up table, which anchor values are then plotted as a y axis value corresponding to each anchor time value displaced along the x axis. A curve is then developed from those plotted anchor values. Curve Generation Processor 33 then operates to multiply the curve so developed by one or more numerical constants representing various linguistic factors. The product curve so obtained, which will represent an accent curve for a speech segment under analysis, may then be added, by Curve Generation Processor 33, to a previously computed phrase curve to produce the $F_0$ curve for that speech segment. Related to the processing described for Critical Interval Processor 31, Anchor Time Processor 32 and Curve Generation Processor 33, an optional parallel process may be carried out by Obstruent Perturbation Processor 34. That processor operates to determine and store perturbation parameters for obstruent consonants and to generate an obstruent perturbation curve from such stored parameters for each obstruent consonant appearing in a speech segment being operated on by Intonation Module 30. Such generated obstruent perturbation curves are provided as an input to Summation Processor 40, which operates to add those obstruent perturbation curves, at temporally appropriate points, to the curve generated by Curve Generation Processor 33. The intonation contour so developed by Intonation Module 30 is then combined with other linguistic representations of the input text developed by preceding modules for further processing by other TTS modules.

CONCLUSION

A novel system and method have been described herein for automatically computing local pitch contours from textual input, which computed pitch contours closely mimic those found in natural speech. As such the invention represents a major improvement in speech synthesis systems by providing a much more natural sounding pitch for synthesized speech than has been achievable by prior art methods.

Although the present embodiment of the invention has been described in detail, it should be understood that various changes, alterations and substitutions can be made therein without departing from the spirit and scope of the invention as defined by the appended claims.

We claim:

1. A method for determining an acoustical contour for a speech interval having a predetermined duration, said acoustical contour being functionally related to a speech waveform processed by a computerized speech processing application, said method comprising the steps of:

dividing said duration of said speech interval into a plurality of critical intervals;

determining a plurality of anchor times within said speech interval duration, said anchor times being functionally related to said critical intervals;

for each of said anchor times, finding a corresponding anchor value from a look-up table;

representing each of said anchor values as an ordinate in a Cartesian coordinate system having as an abscissa said corresponding anchor time;

fitting a curve to said Cartesian representations of said anchor values; and multiplying said fitted curve by at least one predetermined numerical constant related to a linguistic factor to create a product curve, said product curve being representative of said acoustical contour; wherein said acoustical contour is provided as an input to said speech processing application.

2. The method for determining an acoustical contour of claim 1 including the further step of adding said product curve to a pre-computed phrase curve to create an $F_0$ curve.

3. The method for determining an acoustical contour of claim 1 wherein said speech interval having a predetermined duration comprises an accent group.

4. The method for determining an acoustical contour of claim 1 wherein said acoustical contour is a pitch contour.

5. The method for determining an acoustical contour of claim 3 where said step of dividing said speech interval into a plurality of critical intervals produces three said critical intervals: a first interval corresponding to the duration for initial consonants in a first syllable of said accent group, hereafter designated $D_1$, a second interval corresponding to the duration of phonemes in a remainder of said first syllable, hereafter designated $D_2$, and a third interval corresponding to the duration of phonemes in a remainder of said accent group after said first syllable, hereafter designated $D_3$.

6. The method for determining an acoustical contour of claim 5 wherein said relationship between said anchor times and said critical intervals is of the form:

$$T_i=\alpha_{ic}D_1+\beta_{ic}D_2+\gamma_{ic}D_3$$

where α, β & γ are alignment parameters, i is an index for an anchor time under consideration and c refers to a phonetic class of said accent group.

7. The method for determining an acoustical contour of claim 6 where said alignment parameters are determined from actual speech data for a multiplicity of phonetic classes, and within each said class, for each of said plurality of anchor times.

8. The method for determining an acoustical contour of claim 1 wherein said plurality of anchor times is set equal to nine.

9. The method for determining an acoustical contour of claim 1 wherein said plurality of anchor times is set equal to fourteen.

10. The method for determining an acoustical contour of claim 1 wherein said anchor values in said look-up table are determined from an average of a plurality of accent curves obtained from natural speech, said averaged curve being divided along a temporal axis into a plurality of intervals corresponding to said plurality of said anchor times, and said anchor values being read from said averaged curve at a point corresponding to a terminal point for each said interval.

11. The method for determining an acoustical contour of claim 10 wherein said averaged curve for determining said anchor values is normalized to limit a numerical value of each of said anchor values to a range of 0 to 1.

12. The method for determining an acoustical contour of claim 1 including the further step of adding to said product curve at least one obstruent perturbation curve corresponding to an obstruent consonant in said speech interval.

13. The method for determining an acoustical contour of claim 12 wherein said obstruent perturbation curves are generated from a set of stored perturbation parameter corresponding to each obstruent consonant.

14. A system for determining an acoustical contour for a speech interval having a predetermined duration, wherein said acoustical contour is functionally related to a speech waveform processed by a computerized speech processing application, said system comprising:

processing means for dividing said duration of said speech interval into a plurality of critical intervals;

processing means for determining a plurality of anchor times within said speech interval duration, said anchor times being functionally related to said critical intervals;

means for finding an anchor value corresponding to each of said anchor times, said anchor values being stored in a storage means, for representing each of said anchor values as an ordinate in a Cartesian coordinate system having as an abscissa said corresponding anchor time, and for fitting a curve to said Cartesian representations of said anchor values; and means for multiplying said fitted curve by at least one predetermined numerical constant related to a linguistic factor to create a product curve, said product curve being representative of said acoustical contour; wherein said acoustical contour is provided as an input to said speech processing application.

15. The system for determining an acoustical contour of claim 14 further including summation means for adding said product curve to a pre-computed phrase curve to create an $F_0$ curve.

16. The system for determining an acoustical contour of claim 14 wherein said speech interval having a predetermined duration comprises an accent group.

17. The system for determining an acoustical contour of claim 14 wherein said acoustical contour is a pitch contour.

18. The system for determining an acoustical contour of claim 16 where said processing means for dividing said speech interval into a plurality of critical intervals operates to produce three said critical intervals: a first interval corresponding to the duration for initial consonants in a first syllable of said accent group, hereafter designated $D_1$, a second interval corresponding to the duration of phonemes in a remainder of said first syllable, hereafter designated $D_2$, and a third interval corresponding to the duration of phonemes in a remainder of said accent group after said first syllable, hereafter designated $D_3$.

19. The system for determining an acoustical contour of claim 18 wherein said relationship between said anchor times and said critical intervals is of the form:

$$T_i=\alpha_{ic}D_1+\beta_{ic}D_2+\gamma_{ic}D_3$$

where α, β & γ are alignment parameters, i is an index for an anchor time under consideration and c refers to a phonetic class of said accent group.

20. The system for determining an acoustical contour of claim 19 where said alignment parameters are determined from actual speech data for a multiplicity of phonetic classes, and within each said class, for each of said plurality of anchor times.

21. The system for determining an acoustical contour of claim 14 wherein said anchor values stored in said storage means are determined from an average of a plurality of accent curves obtained from natural speech, said averaged curve being divided along a temporal axis into a plurality of intervals corresponding to said plurality of said anchor times, and said anchor values being read from said averaged curve at a point corresponding to a terminal point for each said interval.

22. The system for determining an acoustical contour of claim 21 wherein said averaged curve for determining said anchor values is normalized to limit a numerical value of each of said anchor values to a range of 0 to 1.

23. The system for determining an acoustical contour of claim 14 further including a processing means for generating an obstruent perturbation curve corresponding to an obstruent consonant in said speech interval, and for adding at least one of said generated obstruent perturbation curve to said product curve.

24. The system for determining an acoustical contour of claim 23 wherein said obstruent perturbation curves are generated from a set of stored perturbation parameter corresponding to each obstruent consonant.

25. A computer-readable medium encoded with a computer program for estimation of an acoustical contour for a speech interval, said acoustical contour representing a parameter processed by an automated speech processing application, and said program carrying out essentially the steps of the method for determining such an acoustical contour of claim 1.

* * * * *